US010189151B2

(12) United States Patent
Neubauer et al.

(10) Patent No.: US 10,189,151 B2
(45) Date of Patent: Jan. 29, 2019

(54) COMPACT HEAD BODY HAMMER

(71) Applicant: Snap-on Incorporated, Kenosha, WI (US)

(72) Inventors: Kyle M. Neubauer, Franklin, WI (US); Michael R. Mowry, Kenosha, WI (US); Jonathan I Andersen, Mount Pleasant, WI (US)

(73) Assignee: Snap-on Incorporated, Kenosha, WI (US)

( * ) Notice: Subject to any disclaimer, the term of this patent is extended or adjusted under 35 U.S.C. 154(b) by 206 days.

(21) Appl. No.: 15/350,466

(22) Filed: Nov. 14, 2016

(65) Prior Publication Data

US 2018/0133878 A1 May 17, 2018

(51) Int. Cl.
*B25D 1/00* (2006.01)
*B25G 1/10* (2006.01)

(52) U.S. Cl.
CPC ..... *B25D 1/00* (2013.01); *B25G 1/102* (2013.01); *B25D 2250/391* (2013.01)

(58) Field of Classification Search
CPC . B25D 1/00; B25D 1/12; B25G 1/102; B25G 1/10
See application file for complete search history.

(56) References Cited

U.S. PATENT DOCUMENTS 36,829 A * 11/1862 Boeklen et al. ..... B25D 1/00 7/146
275,025 A * 4/1883 Cowles ..... B25D 1/00 7/146
347,998 A * 8/1886 Dixon ..... B25D 1/00 7/144
376,413 A * 1/1888 Millspaugh ..... B25D 1/00 81/20

(Continued)

FOREIGN PATENT DOCUMENTS

AT 366311 7/2007
EP 0121741 3/1984

(Continued)

OTHER PUBLICATIONS

UK Office Action for Application No. GB1718170.2, dated Apr. 26, 2018, 7 pages.

(Continued)

*Primary Examiner* — David B. Thomas
(74) *Attorney, Agent, or Firm* — Seyfarth Shaw LLP

(57) ABSTRACT

A compact head body hammer that requires less clearance to operate as compared to conventional hammers. The hammer does not include a secondary tool located on the rear of the hammer, for example, a pry or a wedge. In omitting these secondary tools, the hammer provides more clearance and allows greater pull back prior to the user striking an object. Further, the hammer head can weigh substantially the same as a conventional hammer head, for example, seven ounces, (Continued)

so that the striking power of the hammer is not compromised by the compact nature of the hammer. The centerline of the hammer head base can be offset with respect to a centerline of the hammer handle, which also provides less mass at the rear portion of the hammer head and allows greater pull back prior to striking the object.

20 Claims, 3 Drawing Sheets

(56) References Cited

U.S. PATENT DOCUMENTS

| | | | | | |
|---|---|---|---|---|---|
| 572,406 | A * | 12/1896 | Capewell | B25D 1/00 | 7/143 |
| 603,278 | A * | 5/1898 | Kopp | B25D 1/00 | 7/146 |
| 734,738 | A * | 7/1903 | Nelson | B25D 1/00 | 7/146 |
| 752,454 | A * | 2/1904 | Hovland | B25D 1/00 | 425/458 |
| 894,155 | A * | 7/1908 | Layton | B25D 1/00 | 15/143.1 |
| 921,792 | A * | 5/1909 | Brown | B25D 1/00 | 7/146 |
| 1,142,946 | A * | 6/1915 | Ellis | B25D 1/00 | 81/177.1 |
| 1,702,689 | A * | 2/1929 | Duemler | B25D 1/00 | 33/334 |
| 1,737,647 | A * | 12/1929 | Cummings | B25D 1/00 | 81/26 |
| 2,090,164 | A * | 8/1937 | Vaughan | B25D 1/00 | 81/20 |
| 2,184,985 | A * | 12/1939 | Vaughan | B25D 1/00 | 81/22 |
| D140,407 | S | 2/1945 | Henkel | | |
| D151,378 | S | 10/1948 | Leskin | | |
| 2,633,766 | A | 4/1953 | Staszak | | |
| 2,665,434 | A * | 1/1954 | Saunders | A01B 1/08 | 172/252 |
| 2,778,256 | A | 1/1957 | Molnar | | |
| 2,890,018 | A * | 6/1959 | Johnson | B25D 1/00 | 254/26 R |
| 3,596,342 | A | 8/1971 | Willfurth | | |
| 3,640,324 | A | 2/1972 | Porter | | |
| 4,314,593 | A | 2/1982 | Schwartz | | |
| 4,334,563 | A | 6/1982 | Epel et al. | | |
| 5,097,554 | A * | 3/1992 | McLaughlin | B25F 1/00 | 30/123 |
| 5,265,871 | A | 11/1993 | Hanley | | |
| 5,970,551 | A | 10/1999 | Allen | | |
| 8,047,099 | B2 * | 11/2011 | St. John | B25D 1/04 | 81/20 |
| 8,261,634 | B2 * | 9/2012 | St. John | B25D 1/04 | 81/20 |
| 9,259,829 | B1 * | 2/2016 | Cougar | B25D 1/04 | |
| 2005/0102760 | A1 * | 5/2005 | Hayhurst | B25D 1/00 | 7/144 |
| 2006/0075571 | A1 * | 4/2006 | Lin | B25B 13/461 | 7/138 |
| 2007/0057010 | A1 * | 3/2007 | Byrne | B25C 5/11 | 227/133 |
| 2017/0297189 | A1 * | 10/2017 | Lombardi | B25D 1/04 | |

FOREIGN PATENT DOCUMENTS

| | | |
|---|---|---|
| FR | 2931717 | 12/2009 |
| TW | M531360 | 11/2016 |
| WO | 9421431 | 9/1994 |
| WO | 96035554 | 11/1996 |

OTHER PUBLICATIONS

TW Office Action for Application No. 106139256 dated Jul. 3, 2018, 5 pages.

* cited by examiner

COMPACT HEAD BODY HAMMER

TECHNICAL FIELD OF THE INVENTION

The present invention relates generally to hammers. More particularly, the present invention relates to a compact head body hammer adaptable for usage in low clearance areas.

BACKGROUND OF THE INVENTION

Hammers are commonly used in automotive and other applications to tap or strike metal or other objects. Hammers include a head coupled to a handle, which the user grips when striking another object in a swinging motion. Typically, a user will remove the hammer from the object being struck, perhaps by pulling the hammer back, and strike the object from the pulled-back position.

Many hammer applications require use of the hammer in low clearance areas, for example, underneath body panels or fender of a vehicle. Under these circumstances, it is difficult for the user to obtain the necessary clearance to pull the hammer back and strike the desired object with sufficient force. For example, a conventional hammer includes a pry or wedge that removes work pieces or otherwise grips objects on an end opposing the striking end. This pry or wedge is located on a rear side of the hammer head, extending the length of the hammer head beyond what is required for simple striking of the object or work piece. By extending the hammer head length, the hammer head requires additional clearance that can be difficult to obtain in low clearance areas.

SUMMARY OF THE INVENTION

An embodiment of the present invention broadly comprises a compact head body hammer that requires less clearance than conventional hammers. The hammer of one embodiment of the present invention omits any protrusions or additional tools located on the rear side of the hammer head, for example, a pry or wedge, while maintaining substantially the same weight as a conventional hammer, for example, seven ounces. In addition, the centerline of the hammer head body can be axially offset relative to the centerline of the hammer handle, providing less mass on the rear portion of the hammer head and allowing greater pull back prior to striking the object for more effective force.

Another embodiment of the present invention broadly includes a tool including a head having a base and a face extending from the base. The face is adapted to strike an object when the tool is used, and the head has a head centerline extending through a center portion of the base. The tool further includes a handle having a handle centerline extending through a central axis of the handle, wherein the head centerline and the handle centerline are offset relative to each other.

Yet another embodiment of the present invention includes a tool including a head with a base and a face extending from the base. The face is adapted to strike an object when the tool is used, and the head has a rear opposite the face that is devoid of a secondary tool. The tool further includes a handle coupled to the head at the base.

BRIEF DESCRIPTION OF THE DRAWINGS

For the purpose of facilitating an understanding of the invention, there are illustrated in the accompanying drawings embodiments thereof, from an inspection of which, when considered in connection with the following description, the invention, its construction and operation, and many of its advantages should be readily understood and appreciated.

DETAILED DESCRIPTION OF THE EMBODIMENTS

Figure 1:
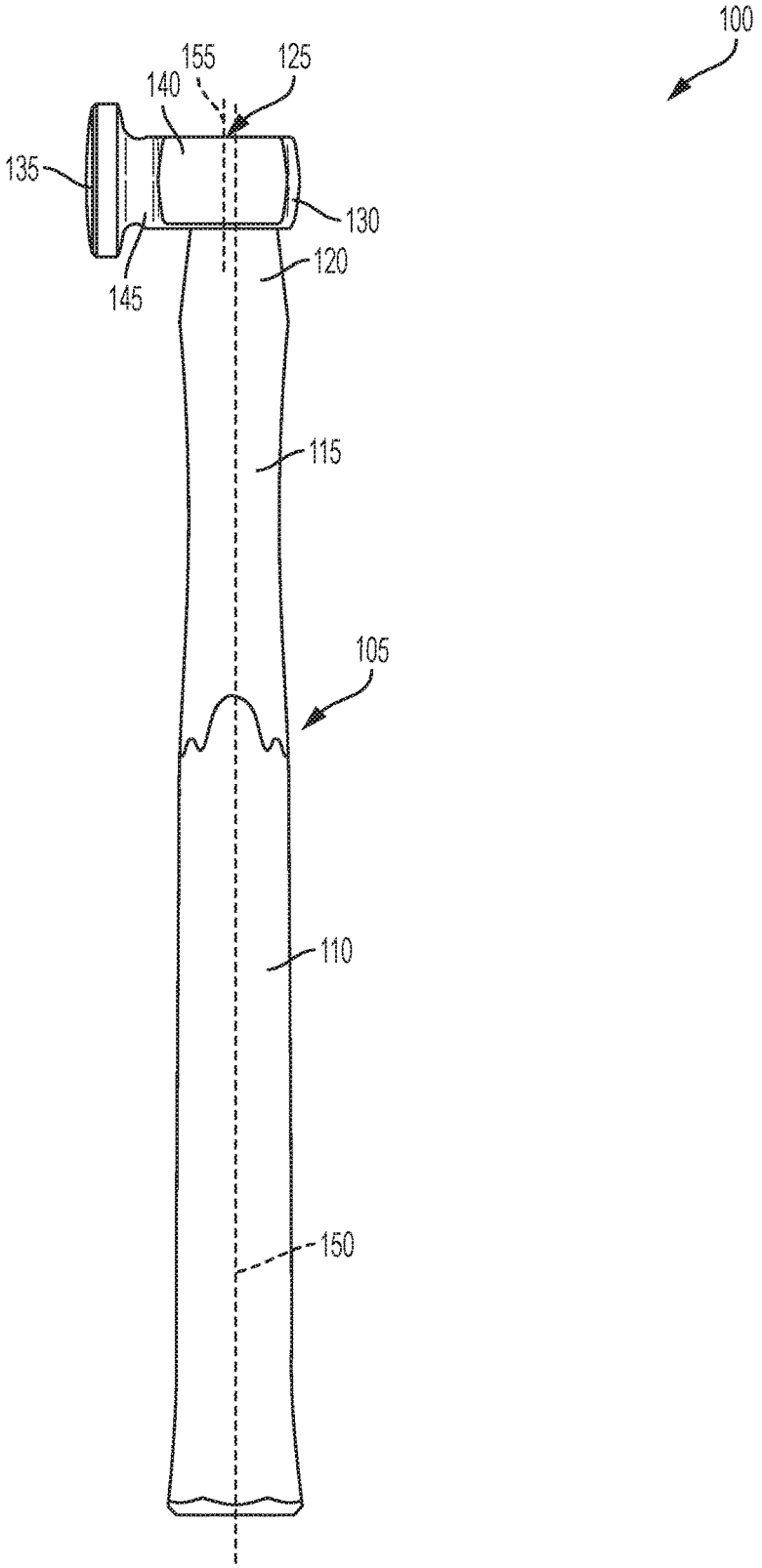
FIG. 1 is a side view of a hammer according to an embodiment of the present invention.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the invention and is not intended to limit the broad aspect of the invention to embodiments illustrated.

An embodiment of the present invention broadly comprises a hammer that requires less swing or arc clearance, compared to a conventional hammer, by omitting additional secondary tools disposed on a rear side of the hammer head, while maintaining substantially the same weight as a conventional hammer, for example, seven ounces. The hammer head and handle can include offset centerlines so that the hammer head includes less mass on the rear portion, allowing greater pull back prior to striking an object.

Referring to FIG. 1, the tool 100 can include a handle 105 having a grip 110 on the lower end of the handle 105 and a neck 115 extending from the grip 110 to a tapered region 120 on the upper end of the handle 105. The tool 100 can also include a head 125, for example a hammer head, coupled to the handle 105 at the upper end of the handle 105. The head 125 can include a rear portion 130 opposite a face 135, where the face 135 is adapted to strike an object when the tool 100 is used and swung by a user.

The grip 110 can be any structure that allows a better grip of the tool 100. For example, the grip 110 can be knurled or otherwise textured, or can include a separate structure, for example, a rubberized tube that fits over the handle 105. Any other manner of improving the grip of a user at the grip 110 can be implemented without departing from the spirit and scope of the present application. Further, the tool 100 need not include any structure at the grip 110 that would improve the grip of a user, and can instead the grip 110 can be the same structure and/or texture as the remainder of the handle 105.

The tapered region 120 can be tapered, for example, can be thinner at a portion near the neck and can be thicker at a portion near the head 125. The tapered region 120 can include a smaller portion of the head 125 extending beyond the rearmost portion of the handle 105, if any portion at all. For example, the tapered region 120 is tapered such that, when connected, the rear 130 of the head 125 extends just past the rearmost portion of the handle 105, if at all. By providing a structure where the rear 130 extends more forward, less head 125 mass is disposed rear of the handle 105 so as to require greater clearance during the pullback process of using the tool 100.

The head 125 can include a base 140 forming the structural backbone of the head 125. The base 145 can couple with the face 135 through a transition region 145. For example, the base 145 can have a width smaller than the width of the face 135, and the transition region 145 can curve or otherwise extend from the base 145 toward the extreme ends of the face 135 to connect the face 135 and the base 145. In some embodiments, the base 145 is centered with respect to the face 135 so as to evenly distribute the weight of the base 145.

The rear 130 of the head 125 can be a flat, rounded, or angled structure. The rear 130 can lack any secondary tools, such as the pries or wedges found in conventional tools, so as to avoid extraneous matter at the rear 130 of the tool 100 that would require additional clearance during use. For example, during use of the tool 100, a user could pull the tool 100 farther back (as compared to conventional hammers or tools) because the tool 100 lacks the secondary tools (such as pries or wedges) located at the rear 130 of the tool 100. Despite lacking the secondary tools, the tool 100 can still weigh substantially the same as a conventional hammer head, for example, seven ounces, so that the striking power of the tool 100 is not limited despite the secondary tools of the head 125 being omitted. To be clear, the use of a seven ounce head is conventional, but the use of a seven ounce head that lacks secondary tools such as pries and wedges, is not, and was invented by the inventors of the present application.

The handle 105 can have a handle centerline 150 and the head 125 can have a head centerline 155. The handle centerline 150 can represent the center of the handle 105 and can extend along a central axis of the handle 105, and the head centerline 155 can extend through a center of the base 140 of the head 125. As shown, the handle centerline 150 and the base centerline 155 can be axially offset relative to each other. In so doing, the rear 130 of the head 125 can be positioned more forward than it would be without the offset nature of the centerlines.

Arranging the head 125 and the handle 105 in this manner requires even less clearance to perform the striking operation with the tool 100, as it moves the head 125 more forward on the handle 105, and an even smaller portion of the head 125 extends beyond the rear edge of the handle 105.

Figure 2:
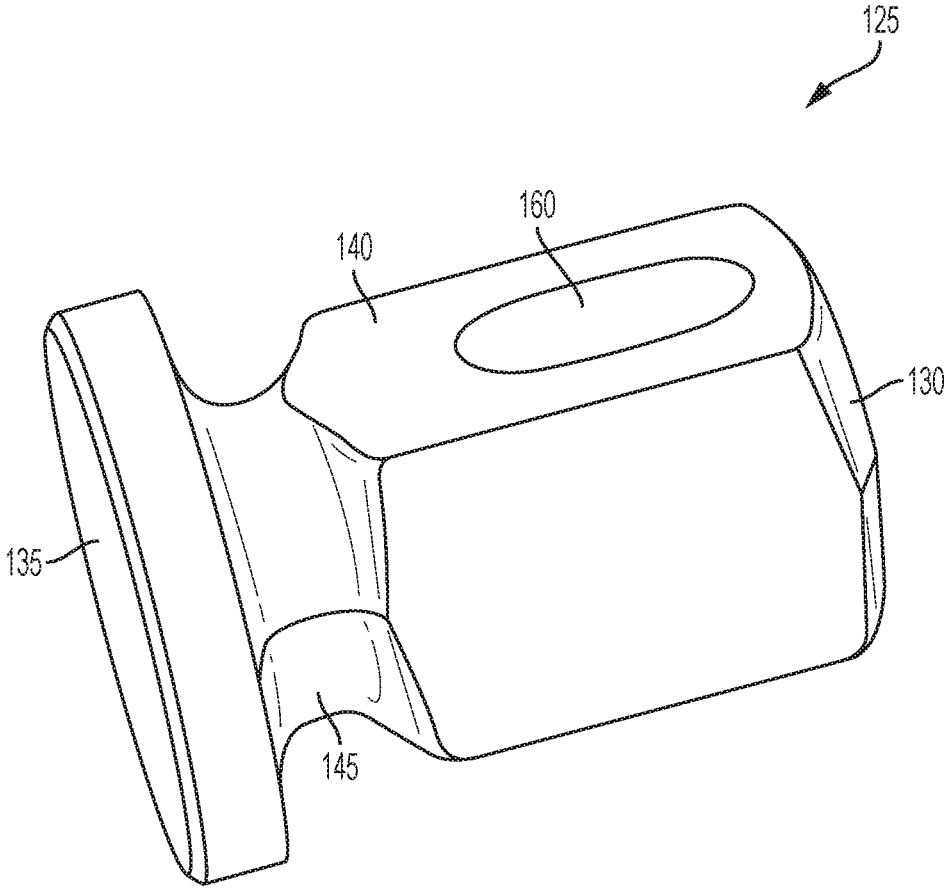
FIG. 2 is a side perspective view of a hammer head according to an embodiment of the present invention.
Figure 3:
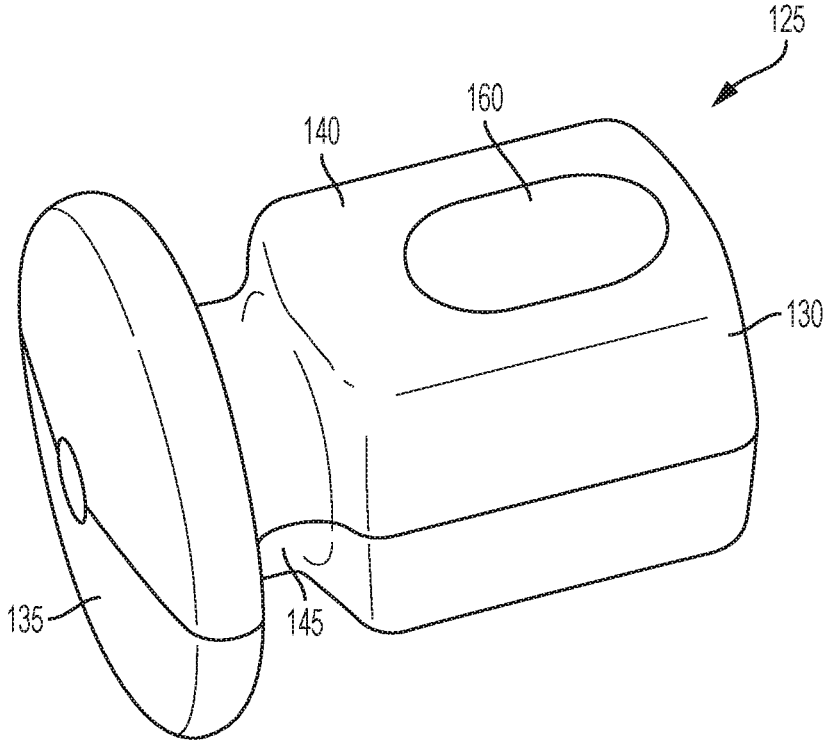
FIG. 3 is another side perspective view of a hammer head according to an embodiment of the present invention.

Referring to FIGS. 2 and 3, the head 125 includes an opening 160 for receiving an end of the handle 105, for example, the end extending from the tapered region 120. The handle 105 can be coupled to the head 125 at the opening 160, or in any other area of the head 125, in any manner. For example, the handle 105 can be coupled to the head 125 by adhesive, fasteners, interference fit, or the handle 105 can be integrally formed with the head 125.

The surface of the face 135 can be flat or semi-flat, for example, rounded. Also, the face 135 can be disk-shaped or otherwise round. However, in some embodiments, the face 135 can be rectangular, square-shaped, triangular-shaped, or oval-shaped. Any other shape of face 135 can be implemented without departing from the spirit and scope of the present application.

As used herein, the term "coupled" and its functional equivalents are not intended to necessarily be limited to a direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and/or described, it will be apparent to those skilled in the art that changes and modifications may be made without departing from the broader aspects of the invention. The actual scope of the protection sought is intended to be defined in the following claims when viewed in their proper perspective.

What is claimed is:

1. A tool comprising:

a head having a base and a face extending from the base, wherein the face is adapted to strike an object when the tool is used, the head includes a head centerline extending through a center portion of the base; and a handle having a handle centerline extending through a central axis of the handle, wherein the head centerline is axially offset relative to the handle centerline.

2. The tool of claim 1, wherein the head includes a rear lacking a secondary tool.

3. The tool of claim 2, wherein the head has a weight of approximately seven ounces.

4. The tool of claim 1, wherein the handle includes a neck and a tapered region extending from the neck proximate the head.

5. The tool of claim 1, wherein the face is flat.

6. The tool of claim 1, wherein the face is rounded.

7. The tool of claim 1, wherein the face is semi-flat.

8. The tool of claim 1, wherein the face has a face width and the base has a base width smaller than the face width.

9. The tool of claim 1, wherein the head includes a transition region coupling the base of the head to the face.

10. The tool of claim 1, wherein the head includes a rear located opposite the base, and wherein the rear is one of round, angled, and flat.

11. The tool of claim 1, wherein the handle includes a grip disposed opposite the head.

12. A hammer, comprising:

a head having a base coupled to a handle and a face extending from the base, the face adapted to strike an object when the tool is operated, the head having a rear opposite the face, the rear being devoid of a secondary tool, and wherein the head includes a head centerline extending through a center portion of the base and the handle includes a handle centerline extending through a central axis of the handle, wherein the head centerline and the handle centerline are axially offset relative to each other.

13. The hammer of claim 12, wherein the head has a weight of approximately seven ounces.

14. The hammer of claim 12, wherein the handle includes a neck and a tapered region extending from the neck proximate the head.

15. The hammer of claim 12, wherein the face has a face width and the base has a base width smaller than the face width.

16. The hammer of claim 12, wherein the head includes a transition region coupling the base of the head to the face.

17. The hammer of claim 12, wherein the rear is one of round, angled, and flat.

18. The hammer of claim 12, wherein the handle includes a grip disposed opposite the head.

19. The hammer of claim 12, wherein the face is one of rounded, flat, and semi-flat.

20. A head for a hammer having a handle with a handle centerline extending through a central axis of the handle, the head comprising:

a base adapted to be coupled to the handle and a face extending from the base, the face adapted to strike an object, the head having a rear opposite the face, the rear being devoid of a secondary tool; and a head centerline extending through a center portion of the base, wherein the head centerline and the handle centerline are axially offset relative to each other when the head is coupled to the handle.

* * * * *